US006653752B2

(12) United States Patent
Huang

(10) Patent No.: US 6,653,752 B2
(45) Date of Patent: Nov. 25, 2003

(54) SWITCH DEVICE OF THEFT-PREVENTED TYPE ALARM

(76) Inventor: Dennis Huang, 1 Fl., No. 1, Lane 9, Ningpo E. St., Taipei (TW)

( * ) Notice: Subject to any disclaimer, the term of this patent is extended or adjusted under 35 U.S.C. 154(b) by 154 days.

(21) Appl. No.: 09/994,688

(22) Filed: Nov. 28, 2001

(65) Prior Publication Data

US 2002/0149267 A1 Oct. 17, 2002

(30) Foreign Application Priority Data

Apr. 12, 2001 (TW) ..... 90205723 U

(51) Int. Cl.[7] ..... H01H 3/26; H01H 47/00; G08B 13/14

(52) U.S. Cl. ..... 307/140; 361/191; 340/571

(58) Field of Search ..... 307/113, 115, 307/125, 126, 130, 139, 140, 141, 141.4, 141.8, 143; 361/160, 166, 167, 170, 187, 189–191; 340/571, 644, 660, 664, 686

(56) References Cited

U.S. PATENT DOCUMENTS 3,975,645 A * 8/1976 Morar ..... 340/429
5,027,105 A * 6/1991 Dailey et al. ..... 340/571
5,061,915 A * 10/1991 Murphy ..... 340/426.12
6,166,635 A * 12/2000 Huang ..... 340/571
6,559,767 B2 * 5/2003 Huang ..... 340/571

* cited by examiner

*Primary Examiner*—Matthew V. Nguyen
(74) *Attorney, Agent, or Firm*—Bacon & Thomas, PLLC

(57) ABSTRACT

A switch device of theft-prevented type alarm has a first switch module controlled by a starting switch so that the first switch module is turned on when the starting switch is pressed at a first time and is maintained in an on state. A second switch module is normally turned on to connect an input power to the first switch module, and outputs power when the first switch module is turned on. A power-off control circuit is coupled to the second switch module. A receiver is provided for activating the power-off control circuit to turn off the second switch module in response to receiving an off signal.

4 Claims, 2 Drawing Sheets

SWITCH DEVICE OF THEFT-PREVENTED TYPE ALARM

BACKGROUND OF THE INVENTION

1. Field of the Invention

The present invention relates to a switch device for initiating an alarm, and more particularly, to a switch device of theft-prevented type alarm.

2. Description of Related Art

Conventionally, a theft-prevented type alarm is used to prevent personal articles, such as a suitcase, a cellular phone, or a briefcase, from being stolen. Such an alarm comprises a portable transmitter carried by the user for transmitting signals, and a receiving and alarming device placed in the personal article. When the distance between the user and the personal article is larger than a predetermined safe distance, the receiving and alarming device cannot receive signals, and thus, alarm is activated to warn the user of a possible theft.

The theft warning capability of above theft-prevented type alarm is achieved only through a reliable power supply. In one case that a thief skilled in the art may turn off the power switch of the receiving and alarming device for disabling the alarm device. In addition, if the power supply of the receiving and alarming device is controlled by a remote switch, the receiving and alarming device has to be switched to a standby mode for being ready to receive a power-on signal at any time, even the alarm is not in use. As a result, electrical energy is wasted significantly. This can adversely affect the performance of the alarm device. Therefore, it is desirable to provide an improved switch device of theft-prevented type alarm in order to mitigate and/or obviate the aforementioned problems.

SUMMARY OF THE INVENTION

An object of the present invention is to provide a switch device of theft-prevented type alarm, which is turned off only by a remote control instead of manual operation.

Another object of the present invention is to provide a switch device of theft-prevented type alarm, which can prevent the waste of electrical energy.

To achieve the above and other objects, the switch device of theft-prevented type alarm in accordance with the present invention comprises: a first switch module controlled by a starting switch so that the first switch module is turned on when the starting switch is pressed at a first time and is maintained in an on state; a second switch module which is normally turned on to connect an input power to the first switch module, and outputs power when the first switch module is turned on; a power-off control circuit coupled to the second switch module; and a receiver for activating the power-off control circuit to turn off the second switch module in response to receiving an off signal.

Other objects, advantages, and novel features of the invention will become more apparent from the detailed description when taken in conjunction with the accompanying drawings.

DETAILED DESCRIPTION OF THE PREFERRED EMBODIMENTS

Figure 1:
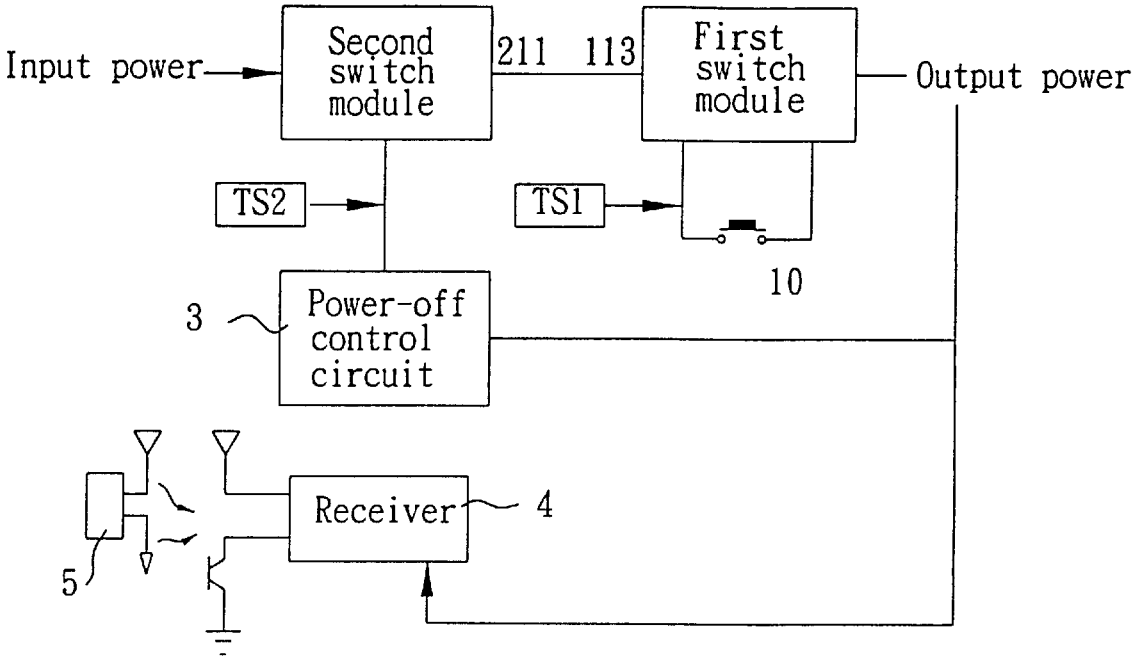
FIG. 1 is a schematic circuit block diagram of a switch device of theft-prevented type alarm according to the invention.
Figure 2:
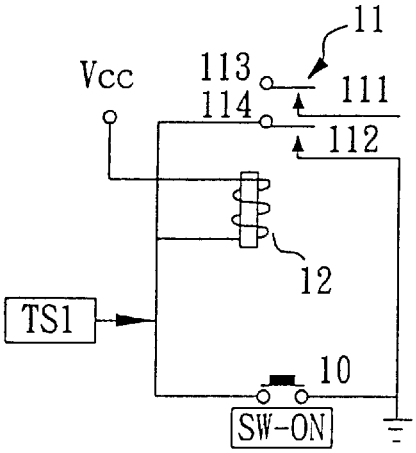
FIG. 2 is a schematic circuit block diagram of a first switch module of FIG. 1.
Figure 3:
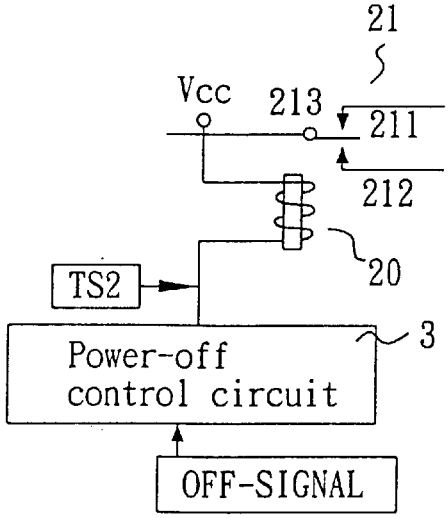
FIG. 3 is a schematic circuit block diagram of a second switch module of FIG. 1.

Referring to FIGS. 1 to 3, there is shown a switch device of theft-prevented type alarm constructed in accordance with the invention, which includes a first switch module 1, a second switch module 2, a power-off control circuit 3, and a receiver 4. Each of above components will be described in detail below.

Referring to FIG. 2, the first switch module 1 comprises a starting switch 10, and a double-pole single-throw relay 11. One end of starting switch 10 is coupled to the second output terminal 112 of the double-pole single-throw relay 11 and further grounded, and the other end is coupled to inductor coil 12 of the double-pole single-throw relay 11 and the second input terminal 114 of the double-pole single-throw relay 11. The second output terminal 112 of the double-pole single-throw relay 11 is provided as a power output terminal.

Referring to FIG. 3, the second switch module 2 is a single-pole double-throw relay 21 having an inductor coil 20 with one end coupled to the power-off control circuit 3, and an input terminal 213 coupled to input power and the other end of the inductor coil 20. The normally closed terminal 211 of the single-pole double-throw relay 21 is coupled to the first input terminal 113 of the double-pole single-throw relay 11. In this preferred embodiment, the relay devices 11 and 21 are used to provide switching functions, which can also be implemented by transistors. Such an implementation is known to those skilled in the art, and thus a detailed description is deemed unnecessary.

With the above circuit, when the switch device is reset, the input terminal 213 of single-pole double-throw relay 21 of second switch module 2 is coupled to the normally closed terminal 211 for providing power thereto. The normally closed terminal 211 is coupled to the first input terminal 113 of the double-pole single-throw relay 11 of first switch module 1. At this moment, if the user wants to activate the alarm, the user has to manually press down the starting switch 10 of the first switch module 1 to apply the current of power source Vcc to the inductor coil 12, so that the first input terminal 113 and second input terminal 114 are switched to couple to first output terminal 111 and second output terminal 112 respectively. Therefore, current from power source Vcc flows to the inductor coil 12 due to the connection of the second input terminal 114 and the second output terminal 112, thereby maintaining the single-pole double-throw relay 21 in an ON state. Accordingly, input power from normally closed terminal 211 of the second switch module 2 is coupled to the alarm through the first input terminal 113 and the first output terminal 111 of the double-pole single-throw relay 11. Hence, toggle switch 10 is turned off. At this moment, since second input terminal 114 and the second output terminal 112 are connected to each other, current continuously flows through the inductor coil 12. This maintains the switch device of the present invention in an ON state, and thus the switch device can not be powered off manually.

Also with reference to FIG. 1, power output from the first switch module 1 is supplied to the power-off control circuit 3 and the receiver 4 for starting the same in addition to the alarm. The receiver 40 can detect whether there is an off signal transmitted from a remote transmitter 5. If such signal is received, the power-off control circuit 3 is activated, so that current from power source Vcc flows through the inductor coil 20 of the single-pole double-throw relay 21, thereby the input terminal 213 being switched to couple to the normally open terminal 212, and thus disconnecting power from the output terminal of the second switch module 2. As a result, the switch device of the present invention is maintained in an OFF state.

Figure 4:
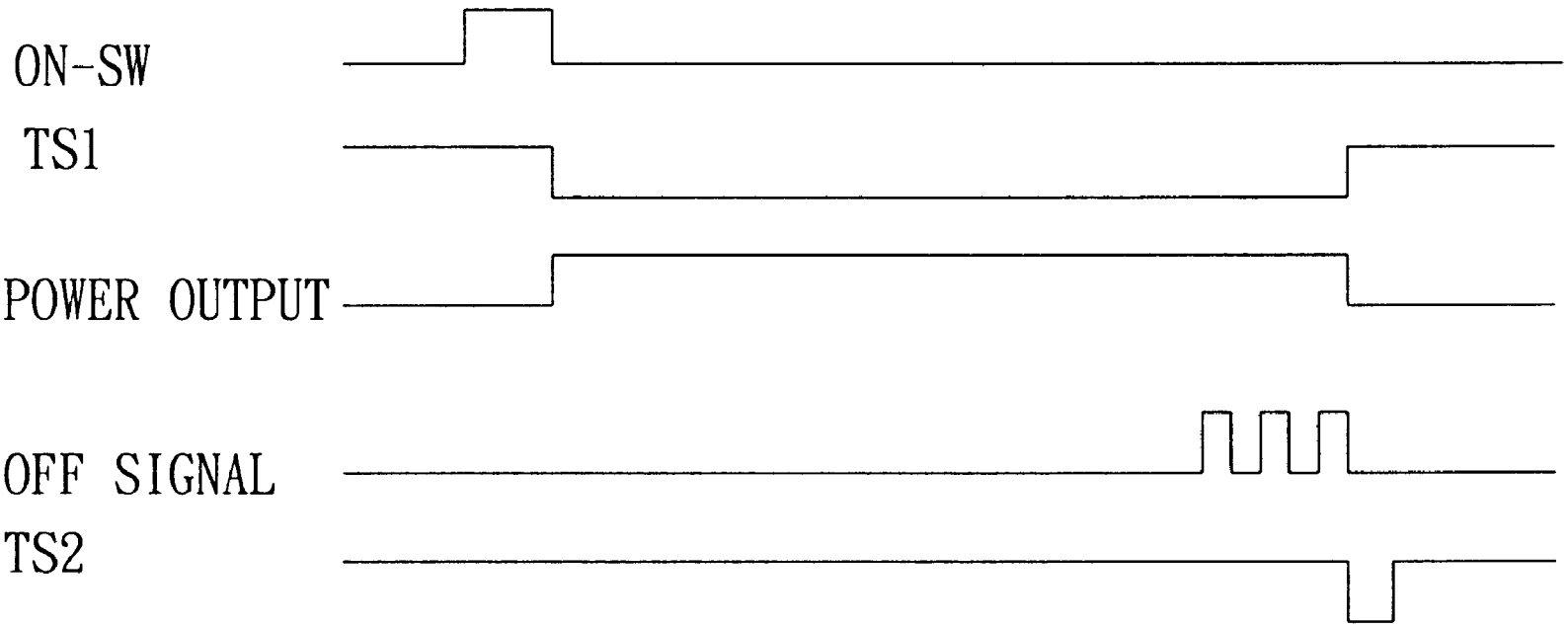
FIG. 4 is a timing diagram of the operation of the switch device of FIG. 1.

Referring to FIG. 4, there is shown a timing diagram of the operation of the switch device. When the starting switch 10 is pressed down, the first switch module 1 is maintained in an ON state and power is coupled to input terminal. This state is changed only when the transmitter 5 transmits an off signal to turn off the second switch module 2 and thus power output from output terminal is inhibited.

In view of the foregoing, the switch device of theft-prevented type alarm according to the present invention is turned on only by pressing the starting switch 10. Once the alarm is turned on, it is impossible to turn off the alarm by a manual operation on the starting switch 10. The alarm can be turned off only by a remote transmitter 5. This can entirely prevent a potential thief from turning off the alarm, thereby providing an excellent theft-proof capability. Moreover, both the receiver and the power-off control circuit consume power only when the switch device is powered on. In other words, there is no electrical energy consumption when the switch device and alarm are turned off, thereby achieving the function of saving energy.

Although the present invention has been explained in relation to its preferred embodiment, it is to be understood that many other possible modifications and variations can be made without departing from the spirit and scope of the invention as hereinafter claimed.

What is claimed is:

1. A switch device of theft-prevented type alarm comprising:

a first switch module controlled by a starting switch so that the first switch module is turned on when the starting switch is pressed at a first time and is maintained in an on state;

a second switch module which is normally turned on to connect an input power to the first switch module, and outputs power when the first switch module is turned on;

a power-off control circuit coupled to the second switch module; and a receiver for activating the power-off control circuit to turn off the second switch module in response to receiving an off signal.

2. The switch device as claimed in claim 1, wherein the receiver and the power-off control circuit are supplied with power from the first switch module.

3. The switch device as claimed in claim 2, wherein the first switch module comprises the starting switch and a double-pole single-throw relay, one end of the starting switch being coupled to a second output terminal of the double-pole single-throw relay and further grounded, the other end of the starting switch being coupled to an inductor coil of the double-pole single-throw relay and a second input terminal of the double-pole single-throw relay, a second output terminal of the double-pole single-throw relay being provided as a power output terminal.

4. The switch device as claimed in claim 2, wherein the second switch module is a single-pole double-throw relay having an inductor coil with one end coupled to the power-ff control circuit, and an input terminal coupled to an input power and the other end of the inductor coil, a normally closed terminal of the single-pole double-throw relay being coupled to the first input terminal of the double-pole single-throw relay.

* * * * *